US009963838B2

(12) United States Patent
Oettinger

(10) Patent No.: US 9,963,838 B2
(45) Date of Patent: May 8, 2018

(54) SCREED ASSEMBLY COMPRISING A WORK STATION

(71) Applicant: JOSEPH VOEGELE AG, Ludwigshafen/Rhein (DE)

(72) Inventor: Klaus Oettinger, Altlussheim (DE)

(73) Assignee: JOSEPH VOEGELE AG (DE)

( * ) Notice: Subject to any disclaimer, the term of this patent is extended or adjusted under 35 U.S.C. 154(b) by 0 days. days.

(21) Appl. No.: 15/314,215

(22) PCT Filed: May 28, 2014

(86) PCT No.: PCT/EP2014/061152
§ 371 (c)(1),
(2) Date: Nov. 28, 2016

(87) PCT Pub. No.: WO2015/180774
PCT Pub. Date: Dec. 3, 2015

(65) Prior Publication Data

US 2017/0198445 A1 Jul. 13, 2017

(51) Int. Cl.
*E01C 19/40* (2006.01)
*E01C 19/48* (2006.01)

(52) U.S. Cl.
CPC ..... *E01C 19/405* (2013.01); *E01C 19/48* (2013.01); *E01C 19/4833* (2013.01); *E01C 2301/14* (2013.01); *E01C 2301/40* (2013.01)

(58) Field of Classification Search
CPC ..... E01C 23/07; E01C 23/01; E01C 19/42; E01C 19/4873; E01C 19/22; E01C 19/48;
(Continued)

(56) References Cited

U.S. PATENT DOCUMENTS 3,000,277 A * 9/1961 Crane ..... E01C 19/008 404/118
5,533,828 A * 7/1996 Campbell ..... E01C 19/174 404/108

(Continued)

FOREIGN PATENT DOCUMENTS

EP 0367479 A2 5/1990
JP 57-168511 U 4/1956

(Continued)

OTHER PUBLICATIONS

PCT International Preliminary Report on Patentablity and Written Opinion of the International Searching Authority dated Nov. 29, 2016, Application No. PCT/EP2014/061152, Applicant Joseph Voegele AG, 7 Pages.

(Continued)

*Primary Examiner* — Abigail A Risic
(74) *Attorney, Agent, or Firm* — Brooks Kushman P.C.

(57) ABSTRACT

A screed arrangement includes a screed assembly (1) for laying a road surface (3), the screed assembly (1) configured to determine a working width (W), viewed in the working direction (R), for laying of the road surface (3). The screed arrangement further includes a working station (9) for an operator (P) mounted on the screed assembly (1). The working station (9) is mounted on the screed assembly (1) in a vibration-decoupled manner, such that the transmission of vibrations from the screed assembly (1) to the working station (9) an be reduced or prevented.

23 Claims, 4 Drawing Sheets

(58) Field of Classification Search
CPC .... E01C 19/405; E01C 19/4833; E01C 21/00; E01C 21/08; E01C 2301/20; E01C 2301/00; E01C 2301/14; E01C 2301/40; E01C 2301/30; E01C 2301/02; E01C 2301/10
See application file for complete search history.

(56) References Cited

U.S. PATENT DOCUMENTS

| | | | | |
|---|---|---|---|---|
| 5,938,371 | A * | 8/1999 | Gustin | E01C 19/48 404/101 |
| 9,534,349 | B2 * | 1/2017 | Horn | E01C 23/01 |
| 9,670,629 | B2 | 6/2017 | Buschmann et al. | |
| 2013/0026244 | A1 * | 1/2013 | Chernyaysky | B60H 1/00314 237/12 |
| 2013/0041567 | A1 * | 2/2013 | Yamashiro | B60T 7/22 701/96 |
| 2013/0058717 | A1 * | 3/2013 | Anderegg | E02D 3/074 404/75 |
| 2013/0142571 | A1 | 6/2013 | Graham et al. | |
| 2013/0142572 | A1 * | 6/2013 | Eul | E01C 19/22 404/118 |
| 2014/0104056 | A1 * | 4/2014 | Ramos | B60Q 1/46 340/471 |
| 2014/0154010 | A1 * | 6/2014 | Steinhagen | E01C 19/48 404/96 |
| 2014/0186115 | A1 | 7/2014 | Graham et al. | |
| 2017/0002525 | A1 * | 1/2017 | Horn | E01C 23/01 |

FOREIGN PATENT DOCUMENTS

| | | | |
|---|---|---|---|
| JP | 2005-36589 | A | 2/2005 |
| JP | 2005248576 | A | 9/2005 |
| JP | 2005248577 | A | 9/2005 |
| JP | 2005248578 | A | 9/2005 |
| JP | 2005248579 | A | 9/2005 |
| JP | 2009-287351 | A | 12/2009 |
| JP | 2014-240594 | A | 12/2014 |

OTHER PUBLICATIONS

PCT International Search Report dated Feb. 4, 2015, Application No. PCT/EP2014/061152, Applicant Joseph Voegele AG, 5 Pages.
PCT International Search Report dated Apr. 2, 2015, Application No. PCT/2014/061152, Applicant Joseph Voegele AG, 5 Pages.
Japanese Search Report dated Sep. 27, 2017, Application No. 2016-569663, 63 Pages.
Japanese Office Action dated Nov. 30, 2017, Application No. 2016-569663, 6 Pages.

* cited by examiner

SCREED ASSEMBLY COMPRISING A WORK STATION

CROSS-REFERENCE TO RELATED APPLICATIONS

This application is the U.S. national phase of PCT Application No. PCT/EP2014/061152 filed on May 28, 2014, the disclosure of which is hereby incorporated in its entirety by reference herein.

TECHNICAL FIELD

The invention relates to a screed assembly comprising a working station.

BACKGROUND

For building road surfaces, screeds are used in practice. The screed is pulled by a road finisher, from the material hopper of which by means of a conveyor installation material for building is distributed in front of the screed.

Conventionally, single functions of the screed are controlled from the cab of the road finisher. For example, various working parameters on the screed components can be adjusted from the cab. Alternatively thereto, the functions of the screed can be controlled by means of a control unit, which is mounted on the side of the screed. The personnel most of the times operates the control unit while they walk next to the screed during installation, or from the position of a walkway, which is arranged transversely behind the screed at the screed frame. From there, however, an accurate control of the control unit is nearly impossible and the personnel needs to simultaneously concentrate on several things, which may cause accidents. In addition, in order to control the control unit mounted on the screed, the personnel comes very close to the operating area of the screed, where work accidents never can be completely excluded.

In fact, the walkway is not provided to stay longer on it, for example to control the control unit from there. The walkway in particular is to enable the operating personnel to cross the newly built road surface without thereby stepping on the hot, eventually even non-compacted installation material, which may lead to undesired imprints.

However, due to the fact that the operating personnel so far has used the walkway also for staying longer in order to in particular control the control unit and to observe the installation from there, certain risks occur for the operating personnel. Specifically, the walkway only has a narrow passage, from which especially in wet weather conditions, one may easily slip off. Moreover, only regarding small screed types, an operation of the control unit can be carried out, which even then is restricted.

SUMMARY

An object of the present disclosure is to provide a screed assembly, which improves the occupational safety for the operating personnel and guarantees an optimized installation, wherein in particular the installation of a new road surface can be carried out by means of a screed assembly in a way that less health risks for the operating personnel occur.

The disclosure relates to a screed assembly for laying a road surface, said screed assembly determining a working width, viewed in the working direction, for laying of the road surface, and a working station for an operator being mounted on the screed assembly, whereby the working station is mounted on the screed assembly in a vibration-decoupled manner, such that the transmission of vibrations from the screed assembly to the working station can be reduced or prevented. The operating personnel, therefore, may also for a longer period comfortably stay on the working station in order to easily observe and if appropriate control the installation, without causing any risks for the operating personnel. Moreover, the vibration-decoupled working station offers a safe place on the screed assembly, where sensitive devices, for example measurement instruments may be stored and kept.

Thereby, vibrations are understood to mean both, speed-dependent vibrations due to moving components of the screed assembly, as well as shocks, leveling movements or other adjusting movements of the screed assembly.

According to a preferred alternative embodiment of the invention, the working station is mounted on a side plate of the screed assembly in order to be associated to an outer area of the working width. The side plate is in particular a (height-) adjustable unit, which for the lateral boundary respectively is mounted on outer ends of the screed assembly. Since regarding most screed assemblies, the basic structure of the respective side plates is essentially the same, independent of the fact whether it refers to a rigid screed assembly, a screed assembly with widening parts or to a screed assembly with extending parts, the working station as well as its mounting on the side plate may be uniform in the type of the screed, resulting in cost savings in manufacturing.

Moreover, from the position of the side plate and the working station attached thereto, the outer area of a newly built road surface can be easily viewed, that is in particular advantageous during end-to-end works, i.e., if road surfaces are built parallel to one another. Furthermore, from this position, numerous operating functions of the screed assembly can be well controlled. For example, form there, a control unit which is mounted laterally on the screed assembly, preferably on the side plate, can be controlled in order to adjust temperatures at components or vibration speeds of compacting components of the screed assembly.

It is in particular preferred, if the working station is mounted on the side plate carrier of the side plate, for example flange-mounted or welded. The side plate carrier essentially runs horizontally along the lateral ends of the screed assembly, whereby a height-adjustable side plate sheet is mounted inwardly of the screed assembly. The side plate carrier forms a robust basis to the mounting of the working station. Moreover, the mounting of the working station on the side plate provides the essential advantage that its structure can be identically constructed for all screed types and that the self-oscillation behavior of the side plate carrier essentially is unchangeable independent from the adjusted working width of the screed assembly so that the vibration-decoupling of the working station at this position can be guaranteed as being especially reliable and can be easily adjusted.

It is expedient, if the working station comprises a mounting unit by means of which it is preferably detachably mounted on the screed assembly, in particular on the side plate carrier. The mounting unit also enables that the working station on a screed assembly of which type so ever can be upgraded and that the working station can switch between different screed types.

According to a preferred alternative embodiment of the disclosure, the mounting unit comprises a vibration-decoupling unit, which reduces vibrations or even completely prevents that vibrations are transmitted to the working station. The thus vibration-decoupled working station provides a location, where the operating personnel can stay for a long time, e.g., over eight hours, without taking health-related risks.

Preferably, the vibration-decoupling unit comprises at least one mass-spring system and/or a shock absorber. The mass-spring system in particular can keep the speed-related oscillations of movable components of the screed assembly away from the working station, resulting in a smooth stand and/or seat for the operating personnel on the working station. The shock absorber can absorb shocks, which for example can occur during starting the road finisher, during crossing unevenness, or during leveling the screed assembly.

It is also conceivable that the shock absorber of the vibration-decoupling unit is automatically reversibly adjustable, in order to always bring the working station back to a desired initial position. Preferably, this is a closed liquid damping spring, which so to speak as a closed unit can be easily mounted and serviced. Alternatively, also a hydraulic shock absorber could be applicable, which is connected to an existing hydraulic system of the screed assembly. Expedient and in particular cost-effective, however, is also the use of a mechanical shock absorber and/or a gas pressure shock absorber.

According to a preferred embodiment, the mass-spring system can be preloaded between the working station and the screed assembly in order to thereby adjust a desired rigidity therein. The hardness degree of the mass-spring system thereby can be individually adapted to operating personnel with different weights.

The vibration-decoupling unit is in particular user-friendly if a preload force of the mass-spring system is manually and/or automatically adjustable. A manual adjustment is for example achievable by a screw construction, by means of which the working station is screwed on against the natural expansion of the mass-spring system. An automatized solution could for example comprise an electric motor being a drive, which due to its activation presses the working station up to a desired preload force against the expansion of the mass-spring system. It would also be conceivable to functionally couple the operation of the electric motor to a weight collection system, whereby the electric motor depending on the collected weight of the operating personnel situated on the working station automatically adjusts the preload force to the mass-spring system.

According to a preferred alternative embodiment of the disclosure, the shock absorber has a variable damping hardness. This could be achieved, for example, by the fact that the displacement volume of a damper fluid can be adjusted per time unit. Similar to the mass-spring system, also in this case the damping hardness could be manually and/or automatically adjustable in order to allow the operating personnel to have maximum individualization of the working station.

It is in particular advantageous if the mounting unit comprises an oscillating bearing which is mounted on the screed assembly and which couples the working station thereto in a foldable manner, the working station being movable by means of the oscillating bearing between a stowing position and a working position. Depending on the requirements, the workstation thereby can be folded out or, in particular for the transport of the screed assembly, can be brought into the stowing position.

It is also useful, if the screed assembly in addition to the working station has a walkway for the operator, on which the operator can also cross the working width behind the screed arrangement during the installation. Preferably, the working station comprises a preferably height-adjustable base plate, on which the operator can stand securely, whereby the walkway extends along a greater area of the working width of the screed assembly than the base plate of the working station. Preferably, viewed in the working direction, the base plate has a greater depth than the walkway so that the operating personnel can remain safely thereon also for longer period of time.

In order to avoid tripping, the base plate is essentially arranged on the same height as the walkway. Viewed from behind, the base plate of the working station therefore looks like an extension of the walkway.

Alternatively, however, the base plate could also be arranged at a higher level than the walkway, as a result of which better insight into the installation and the screed assembly for the operating personnel situated on the working station can be obtained.

A particularly compact alternative embodiment of the disclosure provides that the base plate is arranged in alignment with the walkway and essentially has the same depth as the walkway. This may in particular be advantageous for the transport of the screed assembly, as the base plate of the working station does not project further rearwards than the walkway. In addition, thereby, particularly few edges and corners are formed between the base plate and the walkway, at which the operating personnel could abut.

The working station can be particularly comfortable set for the operator, if the working station comprises a seat, especially a height-adjustable seat. The comfort can even be improved by the fact that the seat is air-suspended.

For the use in case of bad weather conditions, the working station is particularly well suitable, if it is equipped with a weather roof. The weather roof, however, can also be used as a shadow dispenser so that the operating personnel on the working station is not exposed to the blazing sun when the weather is fine.

Preferably, on the working station there is installed a control unit for controlling functions of the working station, for example the height adjustment of the base plate and/or the respective hardness degree of the mass-spring system and/or the shock absorber and/or the screed assembly. The vibration-decoupled working station provides a safe place for the storage as well as for the accurate operation of the sensitive and expensive control unit. By means of the control unit, for example also the levelling of the screed assembly, the tamper speed, temperatures of the heating rods and/or the working width at an extension screed assembly can be adjusted. From the control unit also warning signals can be output in order to alert the operator on the road finisher or to indicate the same that a parameter of the installation ride shall be changed, for example the conveying volume of the installation material. The control unit also can comprise a display, on which current setting parameters of the screed assembly can be displayed.

Furthermore, it is possible that the control unit provided on the working station is functionally connected to an electronic measuring unit, which is attached to the screed assembly and/or directly on the working station. The measuring unit can for example be configured to measure at the side of the screed assembly a distance to the plane, i.e., to the ground on which the road finisher is moving. With respect to this distance, for example the levelling of the screed assembly can be carried out automatically or a layer thickness of the newly built road surface can be calculated. If the measuring unit is mounted on the vibration-decoupled working station, the measurement result could be improved. Moreover, no harmful impacts would be transmitted to the measuring unit.

It is also expedient, if there is arranged a collision protection unit on the working station, which can sense objects approaching the working station. The collision protection unit can be in particular configured such that from the working station it determines the distance to a rear driving roller vehicle, and that it outputs warning signals either itself or via the control unit probably connected thereto, as soon as it approaches the working station too close. These signals can be configured either acoustically or visually.

The working station is in particular comfortable for the operator, if it also has a suction unit, which is configured to suck off vapors of the road surface to be built. The suction unit thereby can either be configured individually or it can be connected to a suction unit already associated to the screed assembly. The suction unit is in particular configured such that it guides the rising vapors below the base plate rearwards away behind the working station and/or collects the rising vapors and conveys them via a provided exhaust air duct over the roof of the road finisher and/or the working station.

For night work, it is helpful if the working station comprises an illumination unit to illuminate primarily the working station itself and the outer area of the working width. The illumination unit in particular helps the operating personnel when entering or leaving the working station as well controlling the control unit.

The working station can be made even more comfortable by designing an air conditioning unit, in particular a heating and/or cooling unit on it. Thereby, according to the weather conditions, the operator can cool or heat the working station. According to a preferred embodiment, the seat mentioned above, thus, is temperable.

Expediently, the working station or at least its essential construction is detachably mounted on the screed assembly so that it can be dismounted from the screed assembly overnight in order to protect the units installed thereon, for example the control unit or the measuring unit from theft.

In particular, preferably the working station can be used on a screed assembly, which is configured as an extension screed. This in particular comprises a main screed and extension parts, which are adjustable relative to the main screed sideways to the working direction in order to continuously vary the working width. The working station preferably is mounted on one of the extension parts in a vibration-decoupled manner, in particular on the side plate carrier of an extension unit. Thus, it is possible to adjust the working station together with the extension part sideways relative to the main screed so that the working station thereby independent of the adjusted working width is always associated to the outer area of the newly built road surface. In addition, essentially the same self-oscillation behavior is always present at the side plate carrier of the extension part independent from the adjusted working width so that the working station can be reliably stored in a vibration-decoupled manner there. At this position, furthermore the installation as well as measurements and also the control of other functions of the screed assembly can be easily monitored.

It is also conceivable that at both extension parts of the extension screed, there is mounted one working station, respectively, wherein the corresponding working stations can correspond to one another in their construction and function. However, the respective working stations can be equipped with different functions according to customer specifications.

According to a further alternative embodiment of the disclosure, the screed assembly is a widened screed assembly with a main screed as well as widening parts, which are selectively attachable at the side thereof in order to enlarge the working width, whereby the working station is mounted on one or on both widening parts in a vibration-decoupled manner.

The above described advantages can be particularly well utilized, if the screed assembly according to the invention is attached to a self-propelled road finisher.

BRIEF DESCRIPTION OF THE DRAWINGS

In the following, a preferred embodiment of the disclosure is illustrated by means of a drawing. In detail, it is shown by.

DETAILED DESCRIPTION

Figure 1:
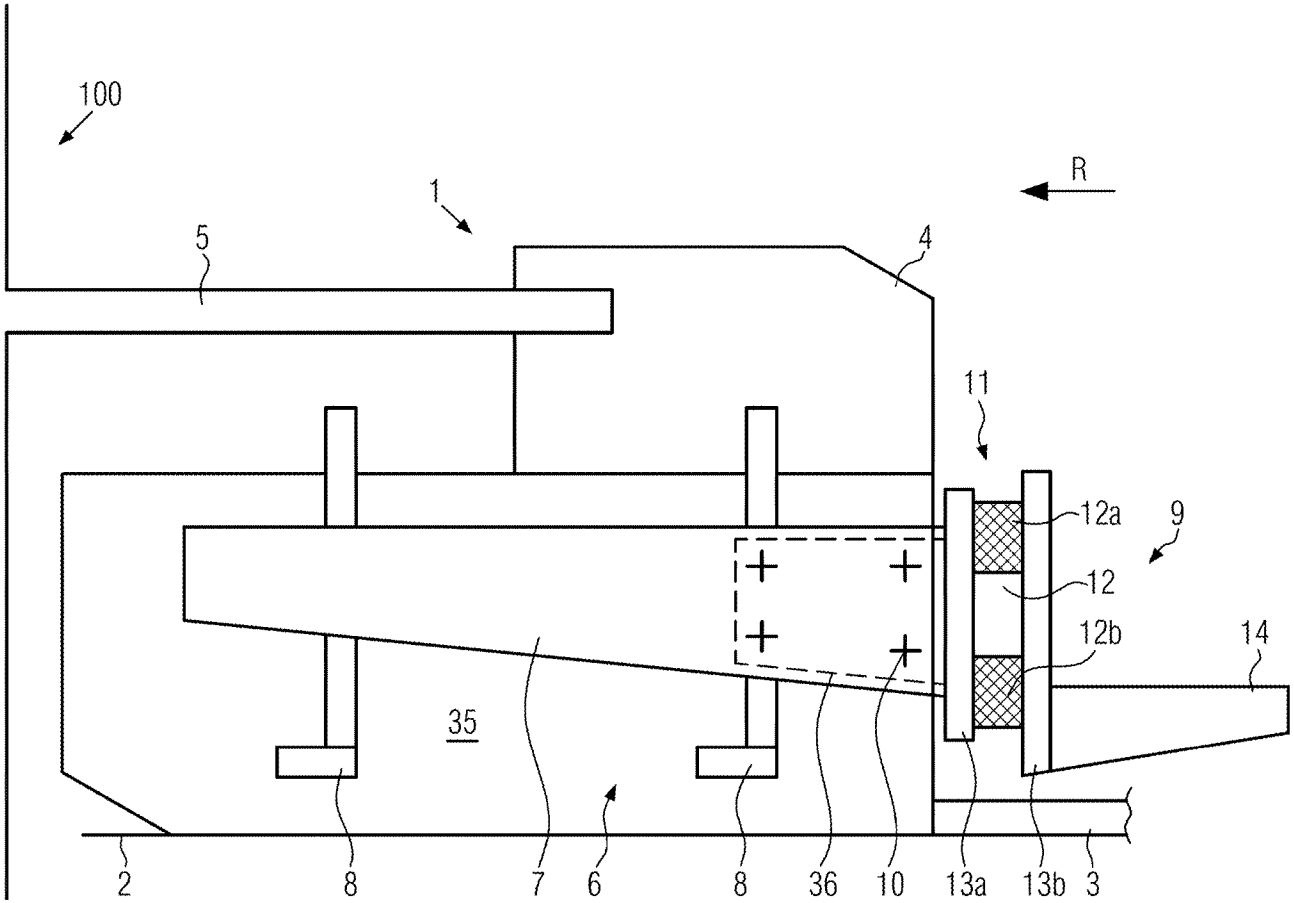
FIG. 1 a road finisher with a screed assembly according to the disclosure.

FIG. 1 shows a side view of a road finisher 100 with a screed assembly 1 attached thereto. The screed assembly 1 is pulled by the road finisher 100 in working direction R on a plane 2 in order to build a new road surface 3. The road surface in particular consists of a bituminous material.

The screed assembly 1 provides a main screed 4, which is fastened via a tension arm 5 to the chassis of the road finisher 100. Viewed from working direction R, there is mounted a side plate 6 externally on the main screed 4. The side plate 6 forms a limitation for the working width W (see FIG. 5) of the road surface 3 to be built and prevents that installation material distributed in front of the screed assembly 1 is displaced sideways from screed assembly 1. The side plate 6 is mounted on the main screed 4 by means of a side plate carrier 7. On the side plate carrier 7, there are mounted setting modules 8, by means of which the height of a side shifting plate 35 of the side plate 6 attached thereto can be adjusted relative to the side plate carrier 7 as well as to the main screed 4. The setting modules 8 can be mechanically or hydraulically adjustable.

Furthermore, FIG. 1 shows that on the rear of the side plate carrier 7, there is mounted a vibration-decoupled working station 9. The working station 9 occupies a region behind the main screed 4 and offers the operating personnel the possibility of standing or sitting on it (see FIG. 2) for a longer period of time, in particular in order to monitor the installation of the road surface 3 in an outer working area of the screed assembly 1. The working station 9 is flange-mounted on fastening positions 10 of the side plate carrier 7.

The working station 9 further has a mounting unit 11, by means of which the working station 9 is mounted on the side plate carrier 7. The mounting unit 11 provides a vibration decoupling unit 12, which is configured to prevent that vibrations are transmitted from the screed assembly 1, in particular the side plate 6 to the working station 9. The vibration decoupling unit 12 is arranged between two perpendicularly arranged mounting plates 13*a*, 13*b* of the mounting unit 11. The mounting plate 13*a* as viewed from the working direction R is connected to a flange plate 36, which is shown with a dashed line and is flange-mounted on the inner side of the side plate carrier 7 by means of suitable fastening means at the fastening positions 10. The mounting plate 13*b* as viewed from the working direction R holds a base plate 14 of the working station 9, which is essentially mounted horizontally. The base plate 14 offers the operating personnel sufficient space for standing there for a longer period of time.

In FIG. 1, the vibration-decoupling unit 12 has a mass-spring system 12*a* and a shock absorber 12*b*. The mass-spring system 12*a* prevents that self-oscillations of the side plate 6 are transmitted to the working station 9. The shock absorber 12*b* absorbs the impacts caused by the screed assembly 1.

Figure 2:
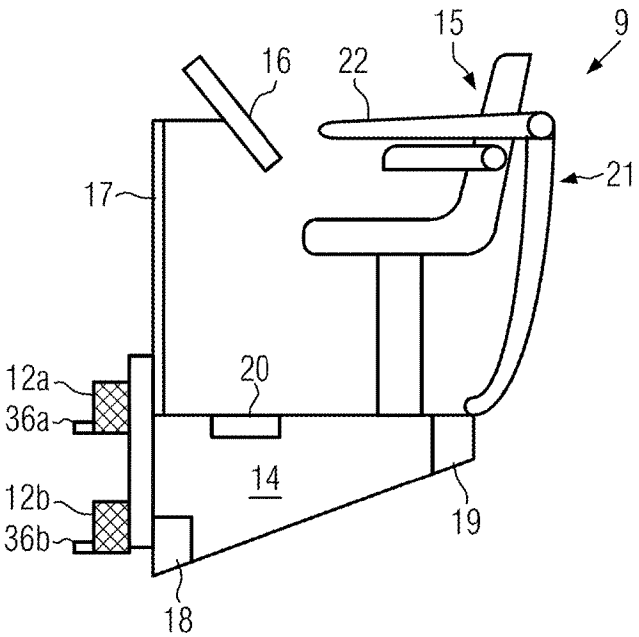
FIG. 2 a working station with seat.

FIG. 2 shows the working station 9 in a side view as sitting working station. The vibration-decoupling unit 12 thereby, viewed from working direction R, is detached from the front mounting plate 13*a* shown in FIG. 1. For a quick detaching as well as mounting of the working station 9, a quick-mount system 36*a*, 36*b* is attached to the mass-spring system 12*a* and the shock absorber 12*b*. On the base plate 14, there is arranged a seat 15. As viewed in working direction R, in front of the seat 15, there is positioned a control unit 16. The control unit 16 is carried by a support 17, which is mounted on the base plate 14. The control unit 16 therefore is as well mounted on the working station 9 in a vibration-decoupled manner.

On the base plate 14, there is further developed a suction unit 18, which is configured for sucking off vapors of the newly built road surface 3. The suction unit 18 can be connected to an already existing suction system of the road finisher 100 in order to suck off vapors from the working area of the screed assembly 1. Alternatively, the suction unit 19 can also be developed as individual unit on the working station 9 for sucking off the vapors, in particular from the outer area of the screed assembly 1.

At the rear of the base plate 14, there is further arranged a collision protection unit 19. The collision protection unit 19 is configured in order to identify an environment relative to the working station 9 in order to either by itself or by the control unit 16 output a warning signal, if an object, for example a rear riding roller vehicle approaches the working station 9 too close.

In FIG. 2, also a heating/cooling unit 20 can be seen, which is mounted on the base plate 14. The heating/cooling unit 20 can be controlled from the control unit 16, whereby it also may be configured in order to regulate automatically the cooling and/or heating performance depending on the environmental temperature of the working station 9. In particular, the heating/cooling unit 20 can be configured in order to temperate the foot area and/or the installed seat of the working station 9.

For an improved occupational safety, the working station 9 according to FIG. 2 comprises a frame 21 with a pivotable door strut 22. If an operator P (see FIG. 3) wants to enter the working station 9 according to FIG. 2, the door strut 22 should be folded up and/or down. If he is situated on the seat 15, he should for safety reasons bring the door strut 22 into the shown horizontal position according to FIG. 2. The frame 21 can also provide fastening possibilities for mounting a tarpaulin and/or cover, which can be arranged as wind protection on the frame 21.

Figure 3:
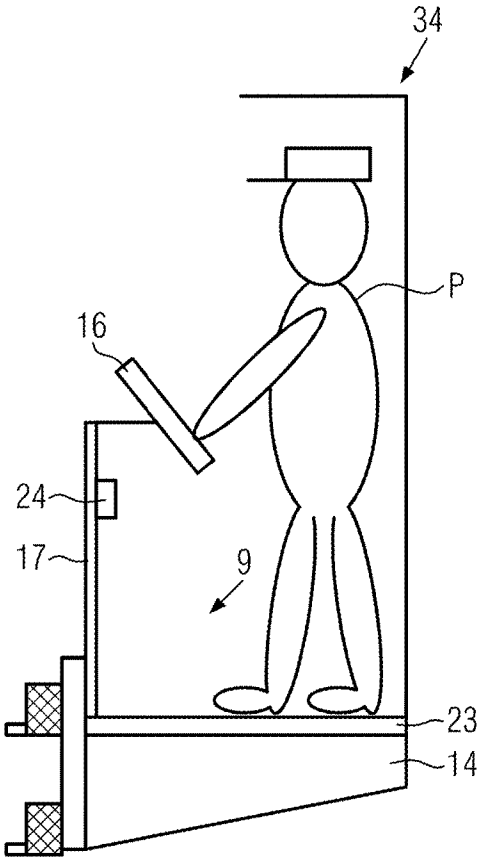
FIG. 3 a standing working station.

FIG. 3 shows the working station 9 from FIG. 2 in a side view without the seat 15 and the frame 21, whereby the operator P stands on a tread element 23 of the working station 9, which is arranged on the base plate 14. The tread element 23 could for example be a rubber mat, in particular with a friction profile so that the operator P can stand slip-resistant on the working station 9 and further has a comfortable soft standing thereon. The vibration-decoupling could be improved for the operator by the fact that if the tread element 21 is made of an impact-absorbing material, for example of a damping polyurethane.

FIG. 3 further shows an illuminating unit 24, which is mounted on the support 17 for illuminating the working station 9. The luminosity of the illuminating unit 24 can preferably be regulated by means of the control unit 16.

The respective components of the working station 9 shown in FIGS. 2 and 3 can be combined with one another upon customers' request. For example, it is conceivable that the standing working station shown in FIG. 3 is equipped with a frame 21 shown in FIG. 2. The tread element 23 could as well be arranged on the base plate 14 of the sitting working station shown in FIG. 2. All working stations 9 according to FIGS. 2 and 3, however, have in common that they and the components installed thereon can be mounted on the screed assembly 1 in a vibration-decoupled manner.

Figure 4:
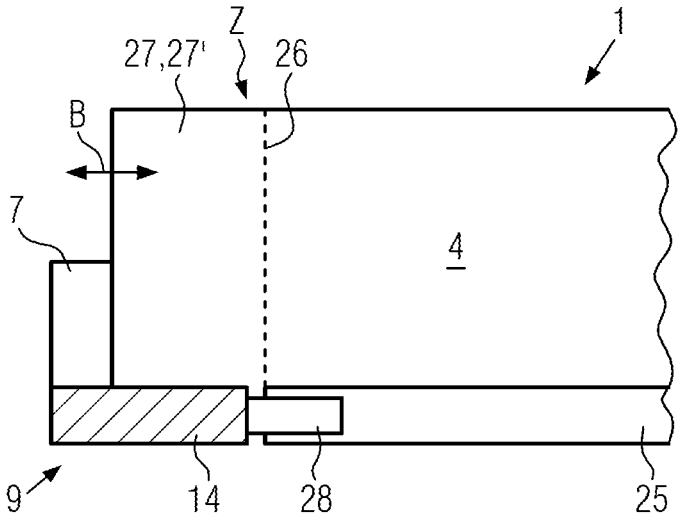
FIG. 4 a schematic illustration of the screed assembly, according to which the working station is located at the same height to the walkway.

FIG. 4 schematically shows in working direction R from a perspective at the rear of the screed assembly 2 the positioning of the working station 9 relative to the walkway 25, which is mounted on the main screed 4 of the screed assembly 1. The walkway 25 normalty extends essentially over the entire width of the main screed 4 and allows the operating personnel P to walk thereon behind the screed assembly 1 without entering the newly built road surface 3.

As can be clearly seen from FIG. 4, the walkway 25 is configured in the outer region of the screed assembly 1 in a shorted manner, so as not to extend beyond the entire working width W behind the screed assembly 1. At this outer region, where the walkway 25 is not extending any more according to FIG. 4, the working station is located, the base plate 14 of which essentially occupies the omitted area of the walkway 25 and which is located at the same height as the walkway 25.

As already illustrated in FIG. 1, the working station 9 also in FIG. 4 is mounted on the side plate carrier 7. As the base plate 14 according to FIG. 4 is located on the same level as the walkway 25, the working station 9 can be well entered also from the walkway 25 and vice versa. Moreover, such a height adapted positioning of the base plate 14 to the walkway 25 results in an inherently consistent appearance, whereby the base plate 14 as viewed from behind acts like an extension of the walkway 25.

In FIG. 4, a dotted line 26 extends through the main screed 4, which is to indicate that the screed assembly 1 shown in FIG. 4 can also be developed as extension screed Z. The extension screed Z, thus, comprises extension parts 27, which are adjustable relative to the main screed 4 sideways in extension direction B in order to consistently extend the working width W of the screed assembly 1. By means of an adjustment of the extension part 27 in FIG. 4 relative to the main screed 4, the working station 9 moves outwardly together with the extension part 27, whereby the base plate 14 moves away from the walkway 25. As can be seen in FIG. 4, an extension 28 is mounted on the base plate 14, which telescopically protrudes the walkway 25. In case of a movement of the extension part 27 being directed sideways outwardly, thus, the extension 28 moves out of the walkway 25 in order to close the gap arising between the base plate 14 and the walkway 25.

Even if the screed assembly 1 shown in FIG. 4 is illustrated as extension screed Z, it also could be developed as rigid screed assembly 1, which optionally comprises only the main screed 4 as well as the working station 9 arranged at the side, or alternatively consist of the main screed 4 as well as of widening parts 27', which can be mounted on the main screed 4 for extending the working area W. The widening parts 27', in fact, do not offer a consistent extending of the working area W, as this is possible by means of the extension parts 27 of the extension screed Z, however, can also mount the working station 9 on the side plate carrier 7 formed thereon.

Figure 5:
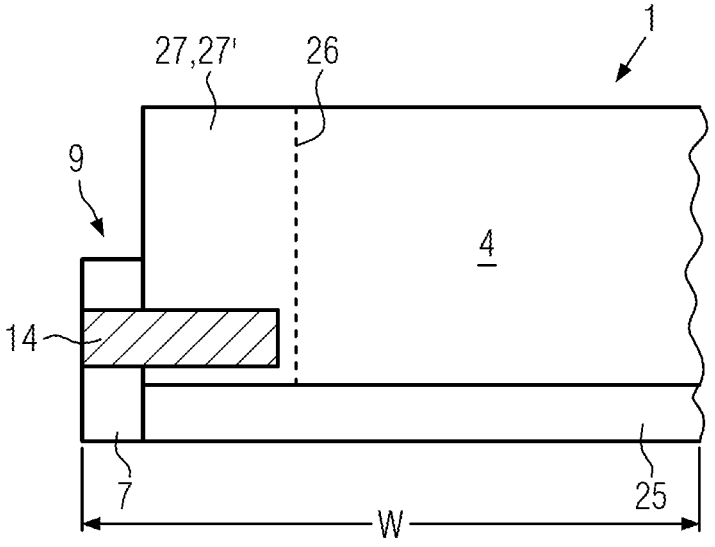
FIG. 5 a schematic illustration with a working station being arranged above the walkway.

FIG. 5 shows the screed assembly 1 from a perspective according to FIG. 4, whereby the base plate 14 of the working station 9 is arranged above an outer section of the walkway 25. The walkway 25 thereby extends over the entire working width W. Similar to FIG. 4, the working station 9 according to FIG. 5 is mounted on the side plate carrier 7. The embodiment alternative according to FIG. 5 can in particular occur, if the working station 9 is upgraded on a road finisher, i.e. on the screed assembly 1.

Notwithstanding, FIG. 4 as well as FIG. 5 show that the working station 9 is respectively located within the working width indicated in FIG. 5 and does not protrude the side plate carrier 7.

Figure 6:
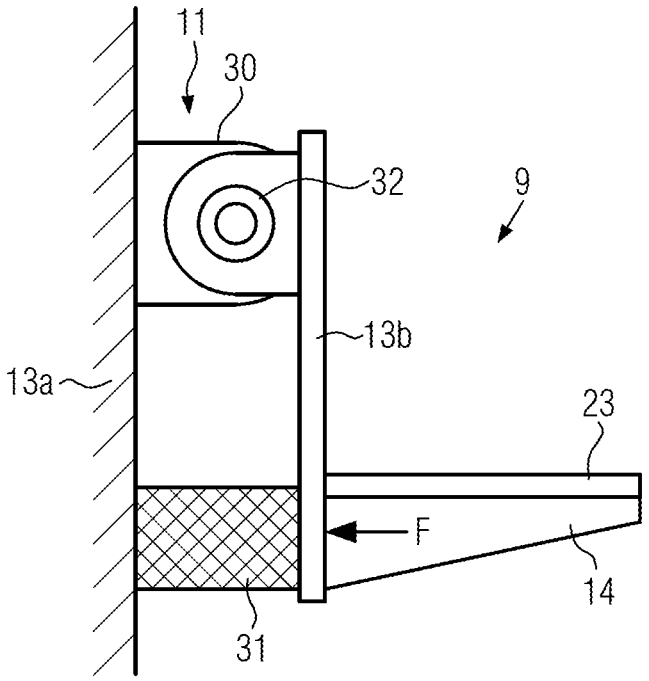
FIG. 6 a working station being fastened by means of an oscillating bearing.

FIG. 6 shows an embodiment variant in a side view according to which the mounting unit 11 comprises an oscillating bearing 30 as well as a preloaded buffer 31. The oscillating bearing 30 and the preloaded buffer 31 are arranged between the mounting plates 13*a*, 13*b*. The oscillating bearing 30 optionally comprises a spring element 32, by means of which the working station 9 can be brought more easily into an upwardly folded stowing position. The damping hardness of the preloaded buffer 31 can be adjusted by a preloading force F so that the working station 9 can be adapted to the weight of the operator P in a user-specific manner.

Figure 7:
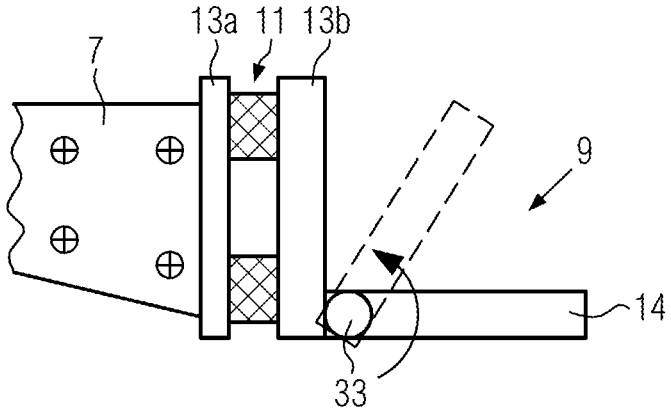
FIG. 7 a foldable working station of the screed assembly according to the disclosure.

FIG. 7 shows in a side view a space-saving, stowable variant of the working station 9, which is adjustable between a working position and a stowing position. Thereby, the base plate 14 can be moved between an essentially horizontal folded-out position, in which it is in the working position, and a vertical, folded-up position, in which it is in the stowed position. The base plate 14 thereby rotates about a needle bearing 33, which fixes the base plate 14 on the rear mounting plate 13*b* of the working station 9 as viewed in the working direction R. In the stowing position, the base plate 14 abuts the rear mounting plate 13*b*, as a result of which the working station 9 can be reduced to a minimum stowage size.

The working station 9 according to the disclosure can be mounted on all known screed assemblies, whether on a rigid screed, an extension screed or on widening parts of a rigid screed, in a vibration-decoupled manner. This results in a comfortable working station 9 for the operator P, from which he can carry out different functions, for example levelling function, measuring functions and/or settings of the working width of the screed assembly 1. The working station 9 can be upgraded on already existing screed assemblies 1 or can be arranged individually upon customers' request relative to the walkway 25.

The working station 9 according to the disclosure provides a new comfort module, as it up to now has not yet been used in respect of road finishers, in particular of a screed assembly. Apart from the additional comfort for the operator, the working station 9 also enables to store sensitive and expensive operating instruments thereon, for example the control unit 16, in a vibration-decoupled manner so that said instruments can be better protected and remain operational for a longer period of time.

The invention claimed is:

1. A screed arrangement comprising:

a screed assembly for laying a road surface, the screed assembly configured to determine a working width, viewed in a working direction, for laying of the road surface, and the screed assembly including a walkway for an operator; and a working station for the operator mounted on the screed assembly in a vibration-decoupled manner, such that transmission of vibrations from the screed assembly to the working station can be reduced or prevented, wherein the working station is mounted on a side plate of the screed assembly in order to be associated to an outer area of the working width, and the working station comprises a base plate on which the operator can stand;

wherein the walkway of the screed assembly extends along a larger area of the working width of the screed assembly than the base plate.

2. The screed arrangement according to claim 1 wherein the screed assembly or the working station comprises a mounting unit that detachably mounts the working station on the screed assembly.

3. The screed arrangement according to claim 2 wherein the mounting unit comprises a vibration-decoupling unit that includes at least one mass-spring system and/or a shock absorber.

4. The screed arrangement according to claim 3 wherein the mass-spring system is mounted between the working station and the screed assembly in a preloaded manner.

5. The screed arrangement according to claim 4 wherein a preload force is manually and/or automatically adjustable to the mass-spring system.

6. The screed arrangement according to claim 3 wherein the vibration-decoupling unit includes the shock absorber and the shock absorber has a variable damping hardness.

7. The screed arrangement according to claim 6 wherein the damping hardness is manually and/or automatically adjustable.

8. The screed arrangement according to claim 2 wherein the mounting unit comprises an oscillating bearing by means of which the working station is movable between a stowing position and a working position.

9. The screed arrangement according to claim 1 wherein the base plate is essentially arranged at a same height as the walkway.

10. The screed arrangement according to claim 1 wherein the base plate is arranged on a higher level than the walkway.

11. The screed arrangement according to claim 1 wherein the base plate viewed from above is arranged in alignment with the walkway.

12. The screed arrangement according to claim 1 wherein the working station comprises a seat for the operator.

13. The screed arrangement according to claim 1 wherein the working station comprises a weather roof.

14. The screed arrangement according to claim 1 further comprising a control unit installed on the working station for controlling the working station and/or the screed assembly.

15. The screed arrangement according to claim 1 wherein the working station provides a collision protection unit, by means of which objects approaching the working station can be determined.

16. The screed arrangement according to claim 1 wherein the working station comprises a suction unit, which is configured for sucking off vapors of the road surface to be laid.

17. The screed arrangement according to claim 1 wherein the working station comprises an illumination unit to illuminate an outer area of the working width.

18. The screed arrangement according to claim 1 wherein the working station comprises a heating and/or cooling unit.

19. The screed arrangement according to claim 1 wherein the screed assembly comprises an extension screed with a main screed and extension parts, which are adjustable relative to the main screed sideways to the working direction in order to vary the working width, and wherein the working station is mounted on one of the extension parts.

20. The screed arrangement according to claim 1 wherein the screed assembly comprises a screed with a main screed and widening parts that can be mounted at a side thereof in order to enlarge the working width, and wherein the working station is mounted on one of the widening parts.

21. A road finisher with a screed arrangement according to claim 1.

22. The screed arrangement according to claim 1 wherein the base plate, viewed in the working direction, extends laterally beyond an outer edge of the walkway.

23. The screed arrangement according to claim 1 wherein the base plate includes an extension that telescopically protrudes into an opening defined by the walkway.

* * * * *